US007387593B2

(12) United States Patent
Ryan et al.

(10) Patent No.: US 7,387,593 B2
(45) Date of Patent: Jun. 17, 2008

(54) PORTABLE SIMULATED PULLING APPARATUS

(76) Inventors: John Ryan, 65 Ashland St., New Rochelle, NY (US) 10801; Joseph J. DiGuglielmo, 15 Fieldstone Dr. # 142, Hartsdale, NY (US) 10530

( * ) Notice: Subject to any disclaimer, the term of this patent is extended or adjusted under 35 U.S.C. 154(b) by 665 days.

(21) Appl. No.: 10/753,038

(22) Filed: Jan. 7, 2004

(65) Prior Publication Data

US 2005/0148437 A1 Jul. 7, 2005

(51) Int. Cl.
*A61B 9/00* (2006.01)

(52) U.S. Cl. ..... 482/37

(58) Field of Classification Search ..... 482/35–37, 482/95–96, 114–118, 92, 23, 34; 182/90
See application file for complete search history.

(56) References Cited

U.S. PATENT DOCUMENTS 641,519 A 1/1900 Kerns
3,599,974 A 8/1971 Price
4,512,570 A 4/1985 Tardivel
5,040,785 A 8/1991 Charnitski
5,076,574 A 12/1991 Johnson, Jr.
5,256,117 A 10/1993 Potts et al.
5,316,535 A * 5/1994 Bradbury ..... 482/135
5,328,422 A 7/1994 Nichols
5,344,371 A 9/1994 Wang
5,354,248 A 10/1994 Rawls et al.
5,380,258 A 1/1995 Hawley, Jr.
5,484,360 A * 1/1996 Haber et al. ..... 482/37
5,492,515 A 2/1996 Charnitski
5,496,234 A 3/1996 Sussich
5,679,100 A 10/1997 Charnitski
6,261,208 B1 7/2001 Carson, Jr.

* cited by examiner

*Primary Examiner*—Fenn C Mathew
(74) *Attorney, Agent, or Firm*—Lackenbach Siegel, LLP

(57) ABSTRACT

A portable simulated pulling exercise apparatus includes an upright support and a variable resistance head member lockably and pivotably connected to the upright support in an adjustable manner. A continuous pulling member runs through the variable resistance head and is pulled by a user. The user can determine the variable pulling resistance and adjust a head member pivot range with a degree of pivot through various degrees of freedom. The Apparatus is collapsible and repositionable for user convenience and portability.

29 Claims, 7 Drawing Sheets

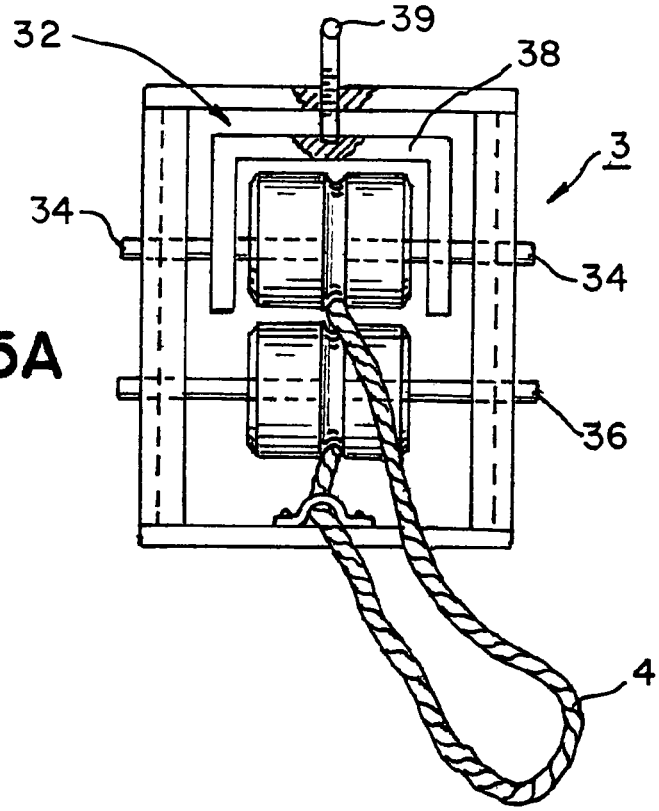
FIG. 5A
FIG. 5B
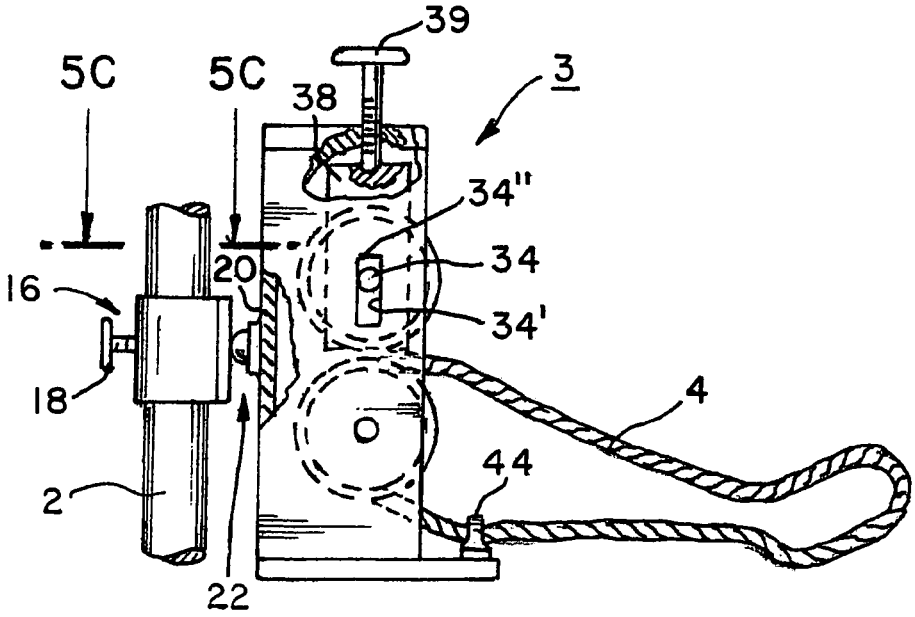

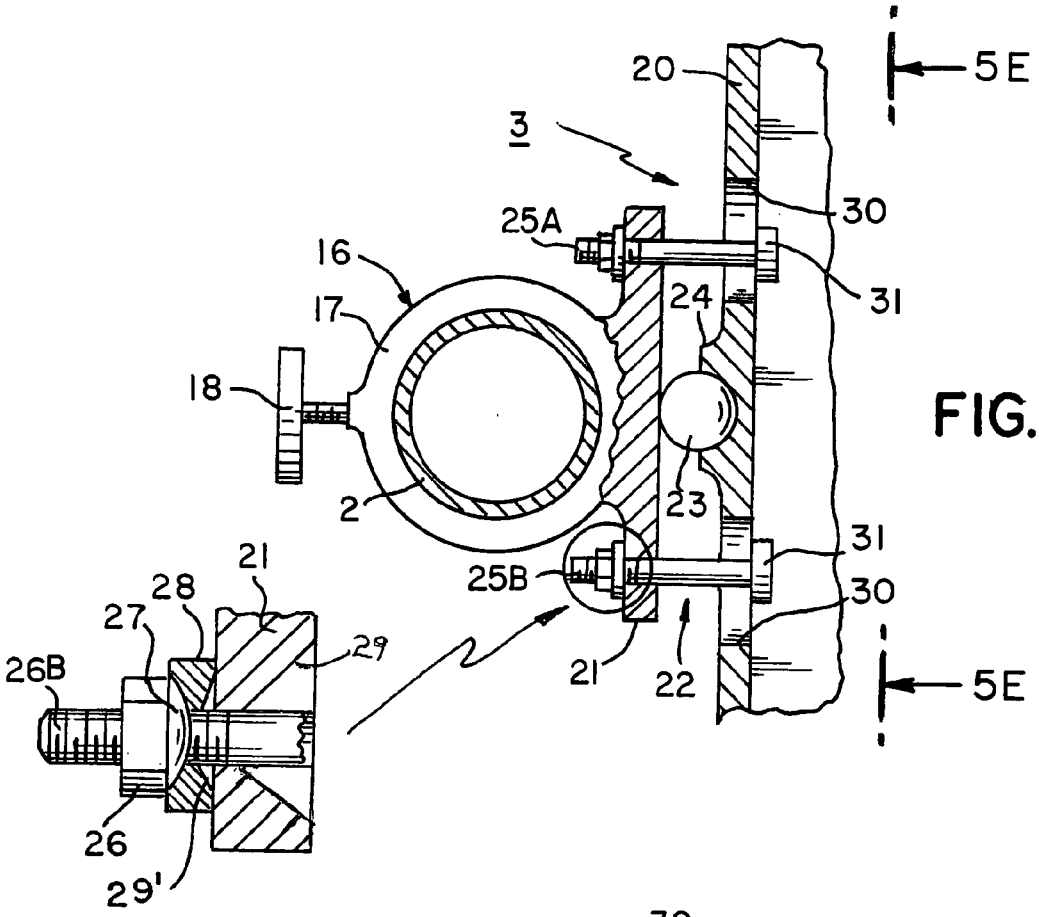
FIG. 5C
FIG. 5D
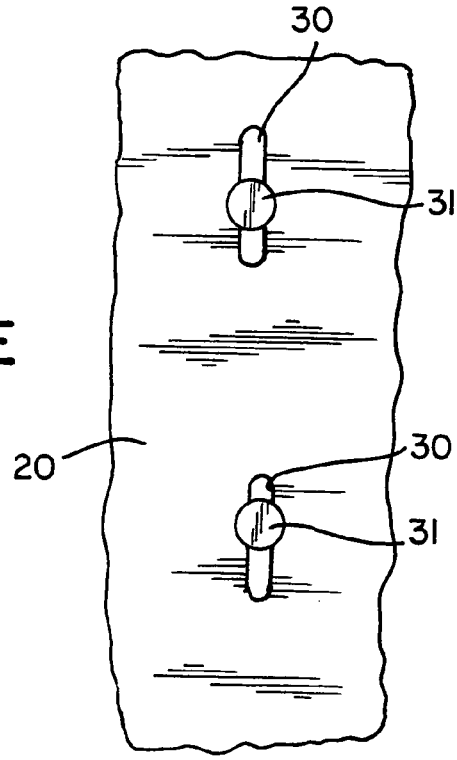
FIG. 5E

PORTABLE SIMULATED PULLING APPARATUS

BACKGROUND OF THE INVENTION

1. Field of the Invention

The present invention relates to a portable exercise device. More specifically, the present invention relates to a simulated pulling or climbing apparatus offering variable resistance and adjustment to accommodate a variety of user types in an easily collapsed and portable design.

2. Description of the Related Art

While no pulling exercise devices are known at present, a broad variety of climbing type devices and machines are known and many include a continuous member for grasping with a user's hands or with through some type of climbing attachment fixed to the continuous member.

One example of a climbing exercise machine operated by a user from an upright position is found in U.S. Pat. No. 5,492,515, by Charnitski. In this invention, a user stands on foot supports and places their hands on handles projecting from a continuous member. The user then alternatingly operates foot-hand pairs along the vertical direction. A linking mechanism associates an operation ration between the foot supports and the handles allowing the user to operate their limbs within normal ranges.

Both U.S. Pat. No. 5,484,360 (Haber et al.) and U.S. Pat. No. 6,261,206 (Carson, Jr.) provide a continuous rope climbing device stretching a vertically aligned continuous member between two opposing horizontal supports. A standing user, then grasps the continuous member with his hands and/or feet and attempts to climb the continuous member resisted by the force of gravity and internal resistance gearing and mechanisms. In Carson, the user employs a stability strap to ensure the user stays proximate the bottom horizontal support.

In Charnitski, Haber, and Carson, the device user must be capable of coordinated quadrupedal, or four-limb (2 hands and 2 feet) motion, using the feet to support and/or move opposite the hands. These devices also represent the use of a taut continuous member to aid the user in gripping and pulling (it is recognized as easier to climb a taut rope then a slack rope). Another commonality of these devices is the ability to discretionally or mandatorily engage a friction-based 'resistance' member that increases the difficulty in climbing.

Other types of conventional climbing exercise machines enable a user to pull a slack (non taut) continuous member, either with or without resistance in a vertical manner.

In U.S. Pat. No. 641,519, E. J. Kerns provides a vertically mounted continuous rope member joined with a rigid coupling and a friction-based means, namely a strap following a smooth drum member. Since this device may be mounted at any height, use by a seated person is possible, unfortunately, as the use is vertically oriented and hence aided by gravity, strengthening of a user's trunk/back is impossible, and the exercise is mainly based in a user's arms.

Johnson, Jr. U.S. Pat. No. 5,076,574 provides another example of a slack/loose continuous member provided in a vertical arrangement with an included resistance member. In this disclosure a member pulls a rope through a triangular-series of pulleys, originating from a top pulley. A user pulls the rope vertically against the support and the pulled-slack portion of the rope is guided horizontally away from the user through a series of channels to a resistance mechanism.

A final example of a slack/loose continuous member exercise machine is discussed in Hawley, Jr. U.S. Pat. No. 5,380,258. In this conventional design, the pulling orientation remains vertical for a standing or seated operator, and the pulled/slack rope is directed horizontally away from the user through a series of pulleys. A pulling/resistance device in the machine is provided by a series of adjustable weights and spring members that act to provide tension on the rope and resist a user's pulling action.

Unfortunately, none of the above-described conventional devices allow the pulling direction of the rope to remain perpendicular and vertical to the resistance means during a user's side-to-side operation. In each case, pulling on the rope forces the rope to pull in a tangential manner to the sheave (pulley wheel), risking the user pulling the rope off the pulley or tangling and damaging the rope or the pulley.

Another detriment of the conventional art is that positionable adjustment to accommodate various users' heights is not provided. Since each conventional art design operates in a vertical manner (pulling downward toward the center of gravity) every user must reach straight upward to grasp the rope and must also employ substantially only arms and biceps muscles. Thus, conventional designs do not accommodate users with disabilities limiting arm and shoulder rising above the horizontal relative to the user's torso.

An additional detriment to the conventional designs is that is that the user does not employ substantial torso strength for each pulling/climbing operation, substantially limiting their anaerobic and aerobic effectiveness.

OBJECTS AND SUMMARY OF THE INVENTION

An object of the present invention is to overcome the detriments of the conventional designs noted above.

Another object of the present invention is to provide an exercise device that allows simple movement for users of all skill levels, from beginners, to the disabled, to moderately fit persons, to professional athletes having both a selectable pulling/climbing resistance and selectable positioning to operate in at least two or more degrees of freedom relative to a user.

It is another object of the present invention to provide an exercise device that utilizes a user's entire musculature frame, from the legs (for support, flexibility, and strength), the trunk (for stability, flexibility, and strength), and the upper body (for flexibility and strength). It is another object of the present invention to provide an exercise device readily adapted to all levels of user skill and provides for both variable pulling/climbing resistance, but the reaching exercise provided by placing a user support at various inclinations relative to the central support member.

It is another object of the present invention to provide an exercise device capable of a therapeutic and rehabilitative operation by a wide variety of users, including partially paralyzed users who could be strapped or positioned in a fixed manner on the device to allow use and strengthening.

Another object of the present invention is to provide an exercise device including a pivoting and variable resistance head member, a continuous pulling or climbing member offering aerobic and anaerobic utilization (strengthening, flexibility, and endurance) and exercise of a user's limbs.

Another object of the present invention is to provide a device allowing simple adaptation to the use of an electronic measurement device for counting at least the time of use, the number of pulls, the length climbed, and an equivalence of energy used or work done, along with various ramped rates of guidance and visual user feedback images.

It is another object of the present invention to allow ready adaptation for the use of an elastic or other weight resistance mans utilizing the central support column as a support structure, where a user pulls against an elastic resistance attached proximate the support column or lifts a weight from a region proximate the central support column.

The present invention relates to a portable simulated pulling exercise apparatus includes an upright support and a variable resistance head member lockably and pivotably connected to the upright support. A continuous pulling member runs through the variable resistance head and is pulled by a user supported on a user support. The user can determine the variable pulling resistance and adjust a head member pivot range with a degree of pivot. The Apparatus is collapsible for user convenience and portability.

According to an embodiment of the present invention there is provided a portable exercise device and apparatus, comprising: at least one upright support member, at least one user support projecting away from the support member, a continuous member, means for positioning and repositioning the continuous member relative to at least one of the support member and the user support, and means for adjusting a pulling resistance of the continuous member, whereby the means for adjusting enables a user to select at least one desired pulling resistance of the continuous member during a use.

According to another embodiment of the present invention, there is provided a portable exercise device, further comprising: at least one means for pivoting the means for adjusting relative to at least one of the user support and the user during the use.

According to another embodiment of the present invention, there is provided a portable exercise device, wherein: the means for pivoting includes at least one of a means for pivoting along a plane extending generally perpendicular to the upright support member and a means for pivoting along both the generally perpendicular plane and a direction generally aligned with the upright support, whereby during the use as the user pulls on the continuous member in a pulling direction, the means for adjusting is alignable and realignable in a position perpendicular to the pulling direction.

According to another embodiment of the present invention, there is provided a portable exercise device, further comprising: wherein: the means for positioning includes a first means for slidably positioning one end of the user support on the upright support member, whereby a slope of the user support is easily adjusted relative to the upright support member and the user support may be positioned proximate to the upright support member during a storage of the device.

According to another embodiment of the present invention, there is provided a portable exercise device, wherein: the means for positioning includes at least first means for slidably positioning the user support into at least one of a use position during the use and in a transport position during a non-use of the exercise device, whereby the use and a portability of the exercise device is improved.

According to another embodiment of the present invention, there is provided a portable exercise device, wherein: the means for positioning includes at least second means for slidably positioning the means for adjusting on the upright support member during the use and a transport of the device, whereby the use and the portability of the exercise device is improved According to another embodiment of the present invention, there is provided a portable exercise device, further comprising: at least a first locking member and a collar member in the first means for slidably positioning, the collar member on the upright support member, the first locking member engaging the collar member in at least one of a threadable engagement and a sliding engagement, the collar member positioning the first locking member relative to the upright support member during the use and the transport, and the first locking member engageable with the upright support member at a plurality of positions enabling a convenient use and transport of the portable exercise device.

According to another embodiment of the present invention, there is provided a portable exercise device, further comprising: at least a second locking member and a second collar member in the second means for slidably positioning, the second collar member on the upright support member, the second locking member engaging the collar member in at least one of a threadable engagement and a slidable engagement, the second collar member positioning the first locking member relative to the upright support member during the use and transport, and the second locking member engageable with the upright support member at a plurality of positions enabling a convenient use and transport of the portable exercise device.

According to another embodiment of the present invention, there is provided a portable exercise device, further comprising: at least one pivot joint pivotally joining a proximate end of the user support with the upright support member, whereby the user support is adjustable to accommodate a variety of user abilities and slope preferences.

According to another embodiment of the present invention, there is provided a portable exercise device, wherein: the at least one pivot joint enabling the user support to be at least one of pivotally repositioned into close proximity with the upright support member and separable from the upright support, whereby a convenient portability of the exercise device is increased.

According to another embodiment of the present invention, there is provided a portable exercise device, further comprising: at least one user limb restraint on a user side of the user support, and the user limb restraint being at least one of a generally T-shaped restraint and a generally U-shaped restraint, whereby during the use, the user limb restraint enables the user to restrain their motion relative to the continuous member and the upright support member.

According to another embodiment of the present invention, there is provided a portable exercise device, wherein: at least one bracing member, and the at least one bracing member forming at least one of a fixed, an adjustable, and a releaseable connection between the user support and the upright support member during the use, whereby the bracing member stabilizes the user support during the use and enables easy reconfiguration of the exercise device into a portable condition.

According to another embodiment of the present invention, there is provided a portable exercise device, further comprising: at least one supportive leg element on the user support opposite the upright support member, and the at least one leg element supporting the user support relative to an external support surface, whereby the at least one leg element provides an additional stability to the user support during the use.

According to another embodiment of the present invention, there is provided a portable exercise device, further comprising: a support member on a bottom side of the upright support member, and the support member including at least one leg extending away from the upright support, whereby the support member and the at least one leg stabilizing the upright support member relative to an external work surface during the use while allowing a simple compaction and portability of the exercise device.

According to another embodiment of the present invention, there is provided a portable exercise device, further comprising: at least one of a rolling member and a sliding surface on support member, whereby the at least one enables a rapid portability of the exercise device after the use.

According to another embodiment of the present invention, there is provided a portable exercise device, wherein: the means for adjusting the pulling resistance further comprises: a housing, a first rolling means and a second rolling means, the first rolling means in the housing pivotable along a first pivot axis, the second rolling means in the housing pivotable along a second pivot axis, the first and second pivot axes parallel to each other, the continuous member passing between and contacting the first and second rolling means, and means for urging the second rolling means toward the first rolling means, whereby the means for urging provides a compression force on the continuous member passing between the first and second rolling means during the use thereby enabling a selection of the pulling resistance during the use.

According to another embodiment of the present invention, there is provided a portable exercise device, further comprising: a bracket in the housing, the bracket movable from a first position to at least a second position, the bracket controllably guiding the second rolling means in the housing relative to the first rolling means, a threaded member in the means for urging, and the threaded member threadably engaging the housing and adjustably urging the bracket and the second rolling means toward the first rolling means, whereby the threaded member enables a threaded selection of the pulling resistance during the use.

According to another embodiment of the present invention, there is provided a portable exercise device, further comprising: a first guide channel on the first rolling means, a second guide channel on the second rolling means, the first and second guide channels radially aligned with each other, and the first and second guide channels providing a guiding alignment to the continuous member during the use, whereby the means for adjusting enables a continuous alignment and realignment of the continuous member during the use.

According to another embodiment of the present invention, there is provided a portable exercise device, further comprising: at least one guide member on the housing, and the at least one guide member positioned at an upstream position from the first and second rolling means, whereby the at least one guide bracket provides an initial alignment to the continuous member during the use prior to the continuous member entering the first and second guide channels.

According to another embodiment of the present invention, there is provided a portable exercise device, wherein: the means for pivoting the means for adjusting further comprises: a first bearing surface in the means for positioning and repositioning, a second bearing surface in the means for adjusting, and pivot bearing means between the first and second bearing surfaces for enabling respective motion of the first and second bearing surfaces during the use.

According to another embodiment of the present invention, there is provided a portable exercise device, wherein: the means for pivoting the means for adjusting further comprises: at least one means for limiting a pivot range of the means for pivoting relative to the upright support member during a use, at least one pivot limiting member in the means for limiting, the pivot limiting member pivotably extending between the first and second bearing surfaces, a first end of the pivot limiting member extending through a slide opening in the second bearing surface, a second end of the pivot limiting member opposite the first end, the second end extending through a sloped opening in the first bearing surface, means for threadably adjusting a distance between the first and second ends of the pivot limiting member in the means for limiting, whereby the means for threadably adjusting enables an adjustment of a distance between the first and second bearing surfaces, and the slide opening and the sloped opening enabling the pivot limiting member to shift relative to both the first and second bearing surfaces during the use, thereby limiting a pivot movement of the means for adjusting when a pivot amount is equivalent to the distance.

According to another embodiment of the present invention, there is provided a portable exercise device, comprising: at least one upright support member, a continuous member, means for positioning and repositioning the continuous member relative to at least the support member, and means for adjusting a pulling resistance of the continuous member, whereby the means for adjusting enables a user to select at least one desired pulling resistance of the continuous member during a use while the means for positioning enables a user to position the continuous member at at least a selected convenient According to another embodiment of the present invention, there is provided a portable exercise device, further comprising: at least one means for pivoting the means for adjusting relative to at least one of the user support and the user during the use.

According to another embodiment of the present invention, there is provided a portable exercise device, wherein: the means for pivoting includes means for pivoting along at least one of a plane extending generally perpendicular to the upright support member and a direction generally aligned with the upright support, whereby during the use as the user pulls on the continuous member in a pulling direction, the means for adjusting aligns and realigns into a position perpendicular to the pulling direction.

According to another embodiment of the present invention, there is provided a portable exercise device, comprising: at least one upright support member, a continuous member, means for positioning and repositioning the continuous member relative to at least the support member, means for adjusting a pulling resistance of the continuous member, whereby the means for adjusting enables a user to select at least one desired pulling resistance of the continuous member during a use while the means for positioning enables a user to position the continuous member at at least a selected convenient position, and at least one means for pivoting and aligning the means for adjusting relative to at least a position perpendicular to a pulling direction during a use.

According to another embodiment of the present invention, there is provided a portable exercise device, further comprising: portability means for repositioning at least one of the continuous member, the means for positioning, the means for adjusting, and the means for pivoting after the use, whereby the portability means enables the use to reposition the exercise device into a compact shape enabling safe and convenient transport.

The above, and other objects, features and advantages of the present invention will become apparent from the following description read in conduction with the accompanying drawings, in which like reference numerals designate the same elements.

BRIEF DESCRIPTION OF THE DRAWINGS

FIG. 5A is a front plane view of one embodiment of the pivoting and variable resistance head member.

FIG. 5B is a partially cut away side view of one embodiment of the pivoting and variable resistance head member.

FIG. 5C is a partial sectional view along line 5C-5C in FIG. 5B.

FIG. 5D is a close up view of one embodiment of the present invention from FIG. 5C.

FIG. 5E is a partial view of the present embodiment of the pivoting and variable resistance head member along section 5E-5E in FIG. 5C.

DETAILED DESCRIPTION OF THE PREFERRED EMBODIMENTS

Figure 1:
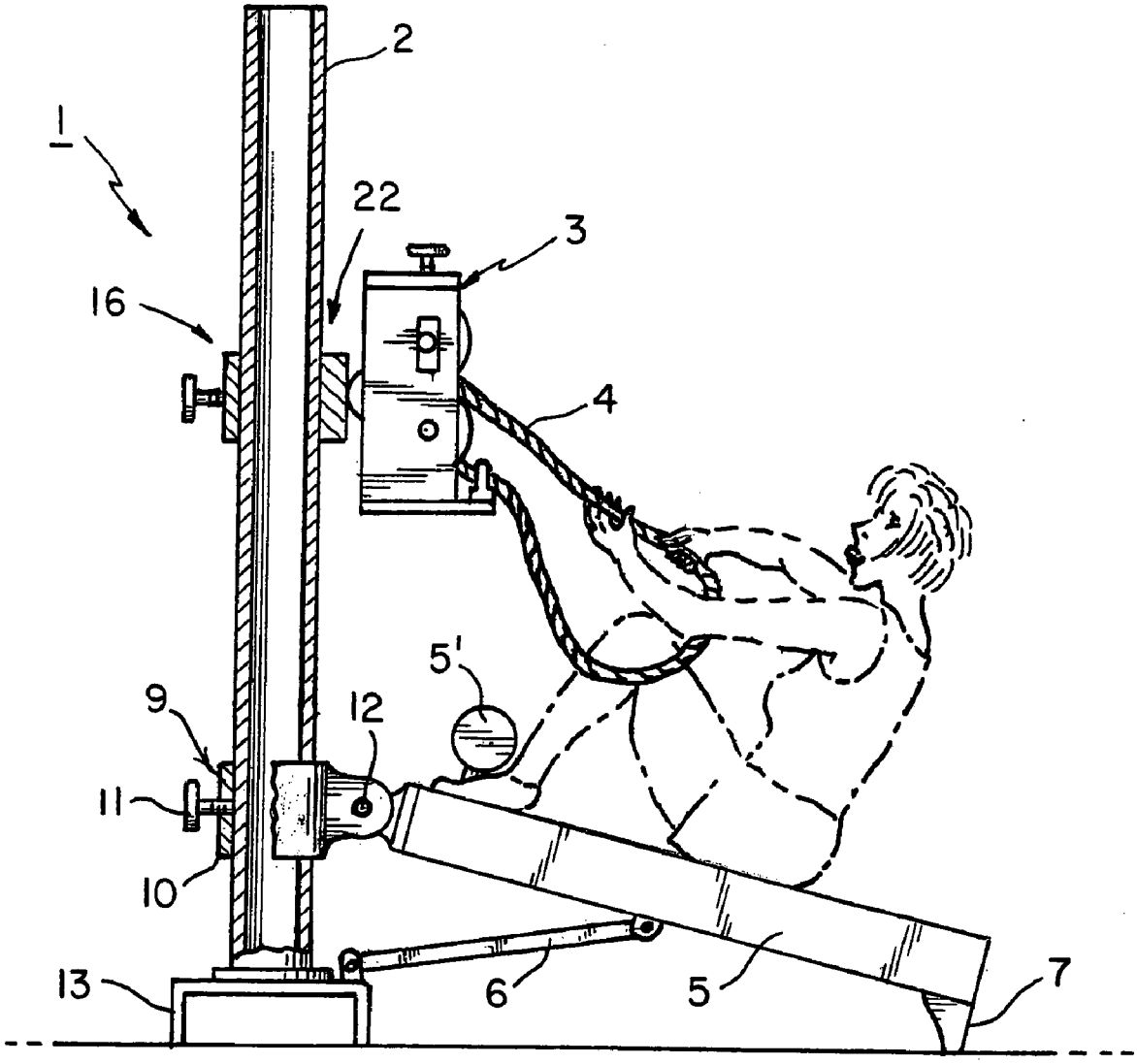
FIG. 1 is a partially cut away side view of one embodiment of the present invention demonstrating a user position and the support structure.
Figure 2:
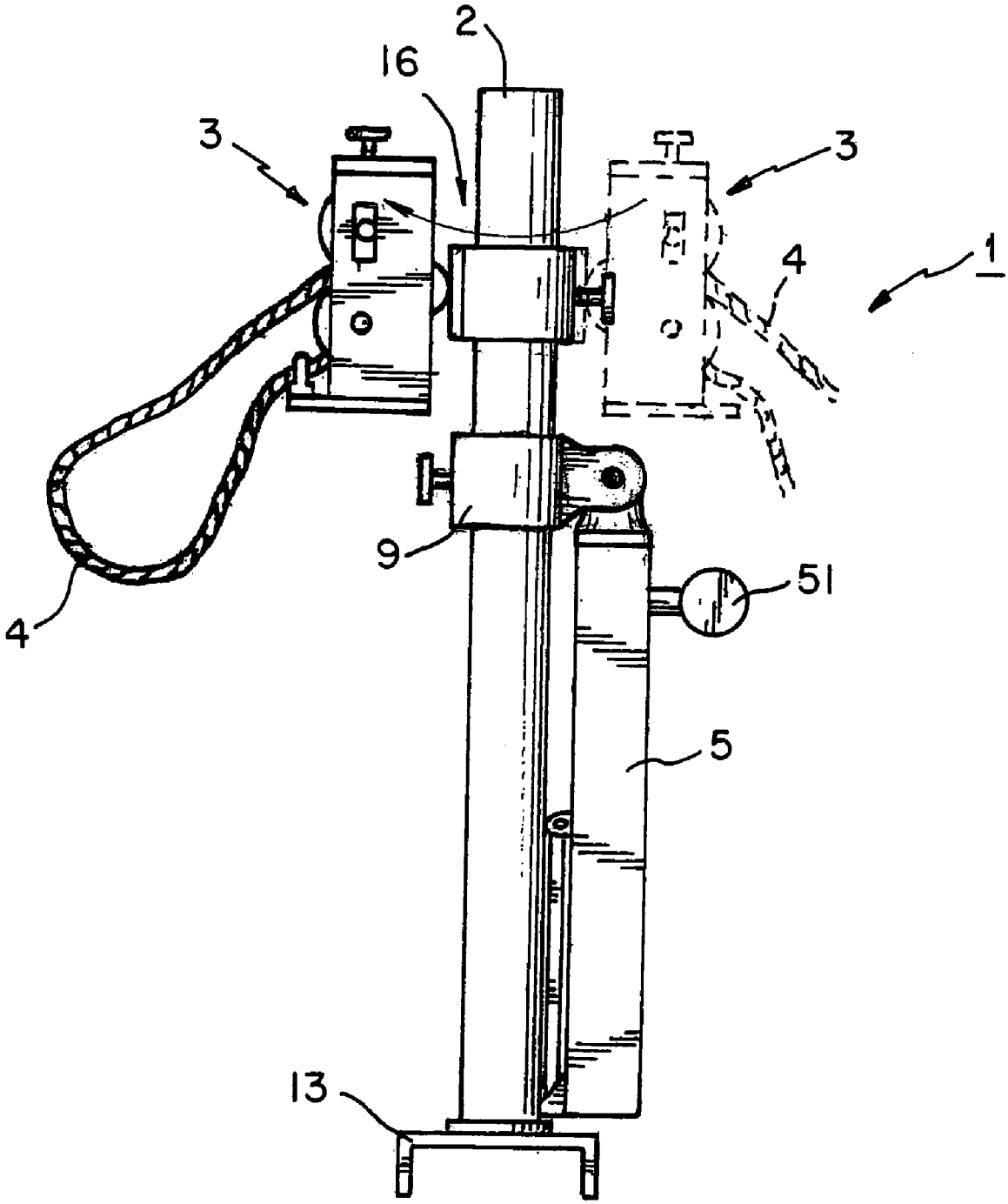
FIG. 2 is a side view of the present embodiment in a collapsed and portable position, noting the pivoting ability of the variable resistance head member.

Referring now to FIGS. 1 and 2 a portable simulated pulling and climbing exercise apparatus 1 includes an upright support 2, a pivoting and variable resistance head member 3 operatively controlling a continuous member 4, and a user support 5. It will be recognized that only one of many preferred embodiments is depicted as a representation of the selected features of the present invention.

A height adjustment means 9 joins user support 5 to upright support 2 opposite support legs 7. In the present embodiment, height adjustment means 9 includes a collar 10 substantially surrounding upright support 2 and enabling a threaded locking member 11 to be adjusted to compressively bear on upright support 2 and lock height adjustment means 9 at a selected height. A pivot joint 12 joins one end of user support 5 to height adjustment means 9 and allows user support to pivot relative to collar 10. In this manner a user may loosen locking member 11 and slidably adjust the upper end of user support 5 along upright support 2 to a self-selected variety of angles relative upright support 2 and a supporting surface for exercise apparatus 1. In this manner, the present invention enables a user to determine a user's exercise difficulty and flexibility level during a use.

Continuous member 4, as preferably used, is a woven rope member made from natural or man-made fibers, or a combination of both. Continuous member 4 may also be formed from a continuously extruded man-made material, such as nylon or plastic. In the preferred embodiment shown, continuous member is formed without a detectable merge point between the two formed ends. Where a fibrous material is used, the material ends are woven together using traditional roving/splicing (joining textile fibers) techniques to create an operationally seamless joint. As will be described below, during use it is preferable for continuous member 4 to operate without a joint, as the existence of a joining point may create a change in pulling/climbing resistance for the user and hence an undesirable distraction during operation.

It should be understood by those skilled in the art, that while the present exercise apparatus 1 will function without flaw while employing a continuous member 4 with a joint (which increases or decreases a rolling resistance during use), in one of the preferable embodiments of the present invention as shown, continuous member 4 is formed without a joint. It is similarly envisioned, that while one preferred embodiment employs continuous member 4 in a substantially non-elastic manner, alternative embodiments employing partially or substantially elastic continuous members may be used depending upon a user's preference.

An optional bracing member 6 extends proximate a bottom support member 13 of upright support 3 to join an underside of user support 5 between support legs 7 and collar 10. Bracing member 6 is optionally provided as a stiffening member to minimize a flexing of user support 5, but may be differently provided or eliminated as needed depending upon a stiffness of user support 5. Bracing member 6 may also include a length adjusting mechanism (not shown) allowing a user, after selecting a desired slope of user support 5 relative to upright support 2, to accommodate different distances between user support 5 and bottom support member 13.

A height adjustment and rotation means 16 and a pivot bearing means 22 are in pivoting variable resistance head 3. As will be shown and described below, height adjustment and rotation means 16 enables at least resistance head 3 to be repositioned and repositioned both vertically and side-to-side relative to upright support 2. In this manner, height adjustment and rotation means 16 enables a user to adjust the operable height of resistance head 3 and continuous member 4 relative to both the user and the user support prior to a use. In this manner, and as will be later described in further detail, the present embodiment accommodates users of various heights, trunk sizes, arm lengths, and fitness levels.

Height adjustment and rotation means 16 also enables a user after use to either raise resistance head 3 along support 2 to accommodate a repositioned user support 5, or to reposition resistance head 3 to a back or other portion of support 2 to enable a compaction of exercise apparatus 1 for transport, sale, shipping, and/or storage.

Pivot bearing means 22 enables an adjustment prior to, during, or after use of resistance head 3 relative to the user (shown in shadow) and the user support 5. In this manner resistance head 3 accommodates users of all sizes and fitness levels. As will be later described below in detail, pivot bearing means 22 additionally enables resistance head 3 to be optionally fixed at a selected position relative to the user (i.e. a selected tilted position perpendicular to a pulling direction) or to remain adjustable and movable through a range of pulling directions (i.e. pivoting side to side (through 2 degrees of freedom) and/or side to side and up and down (through 3 degrees of freedom) depending upon a user's adjustment and position of the elements within resistance head 3.

It should be understood, that FIG. 1 depicts an assembled in-use embodiment of the present invention for an average user. Resistance head 3 and user support 5 may be adjusted vertically and fixed vertically relative to upright support 2 to accommodate various user body types and levels of fitness. Where a large and fit user is present, resistance head 3 and user support 5 may be positioned high on upright support 2. This position accommodates the user's larger arms (greater pulling reach and distance), and forces the user to accomplish an inclined sit-up motion prior to each pulling-away motion. Consequently, a large and fit user exercises their upper body, trunk (abdomen and back), and lower body musculature (including minor stabilizing musculature) in each motion. Depending upon a user's repetitions, the resistance selected (later described) and the angles of reach and incline, the user may fatigue rapidly in an anaerobic effect, or may fatigue more slowly resulting in an aerobic effect.

It should be understood, that FIG. 2 depicts a transportation and storage embodiment of the present invention. Many manners of compaction and storage are envisioned. The embodiment selected shows variable resistance head 3 raised and pivoted to a rear side of support 2, and a lifting of height rotation adjusting means 16 along support 2. Raising height-adjusting means 16 along support 2 brings user support 5 into close alignment with user support 5, where it may be secured with a retention catch means (not shown) or with common elastic retention members. In this manner, it should be understood, that exercise apparatus 1 may be positioned in a substantially compact elongated shape for rolling under a bed or sliding into a closet or cabinet.

Bottom support member 13 is shown, in the present embodiment, including supporting and stabilizing bracing leg members projecting outward from upright support 2. It will be appreciated that a wide variety of support members may be adapted to provide stabilizing support to upright support 2, and to optionally, on other embodiments not presently shown, allow a rolling or a sliding of exercise apparatus 1 for convenient storage. Consequently, it should be understood, that in alternative embodiments bottom support member 13 and/or upright support 2 may include wheels, locking wheels, repositionable wheels, single or multiple sliding members, alternatively designed brace legs and bracing members and other elements common and understood in the art as useful in operably supporting an upright support member while allowing simple and easy portability after use.

Figure 3A:
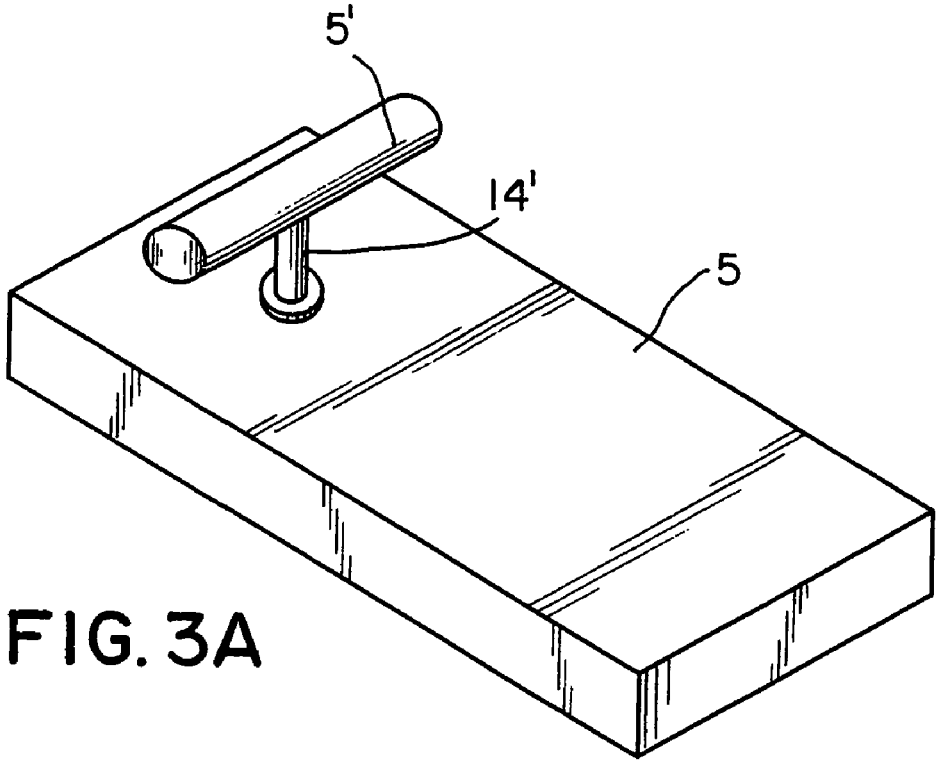
FIG. 3A is one embodiment of a user support.
Figure 3B:
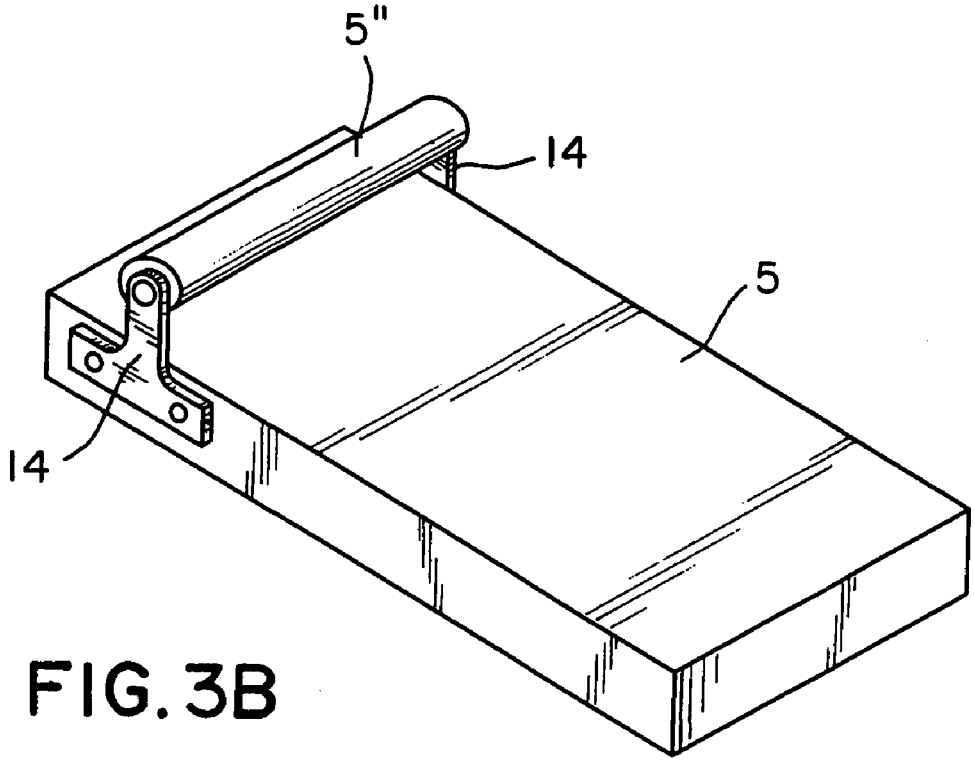
FIG. 3B is another embodiment of a user support.

Additionally Referring now to FIGS. 3A and 3B, alternative embodiments of user support 5 may optionally include a T-type foot or leg brace 5' or a U-type foot or leg brace 5'''. Where user support 5 employs a T-type foot or leg brace 5', a central support 14' joins the surface of user support 5 with the approximate center of the foot or leg brace 5'. Where user support 5 employs a U-type foot or leg brace 5'' then two oppositely positioned side supports 14, 14 join opposite ends of foot or leg brace 5'' with sides of user support 5. Additionally, a cushion or other surface material (not shown) may be positioned on a user side of user support 5 for user comfort or to provide user traction and positioning traction for safety during use. It should be understood, from the selected embodiments shown, that user support 5 may be optionally employed without leg elements 7, or with other support-type leg elements suitable to stabilize and secure user support 5 during a use and transport.

Figure 4:
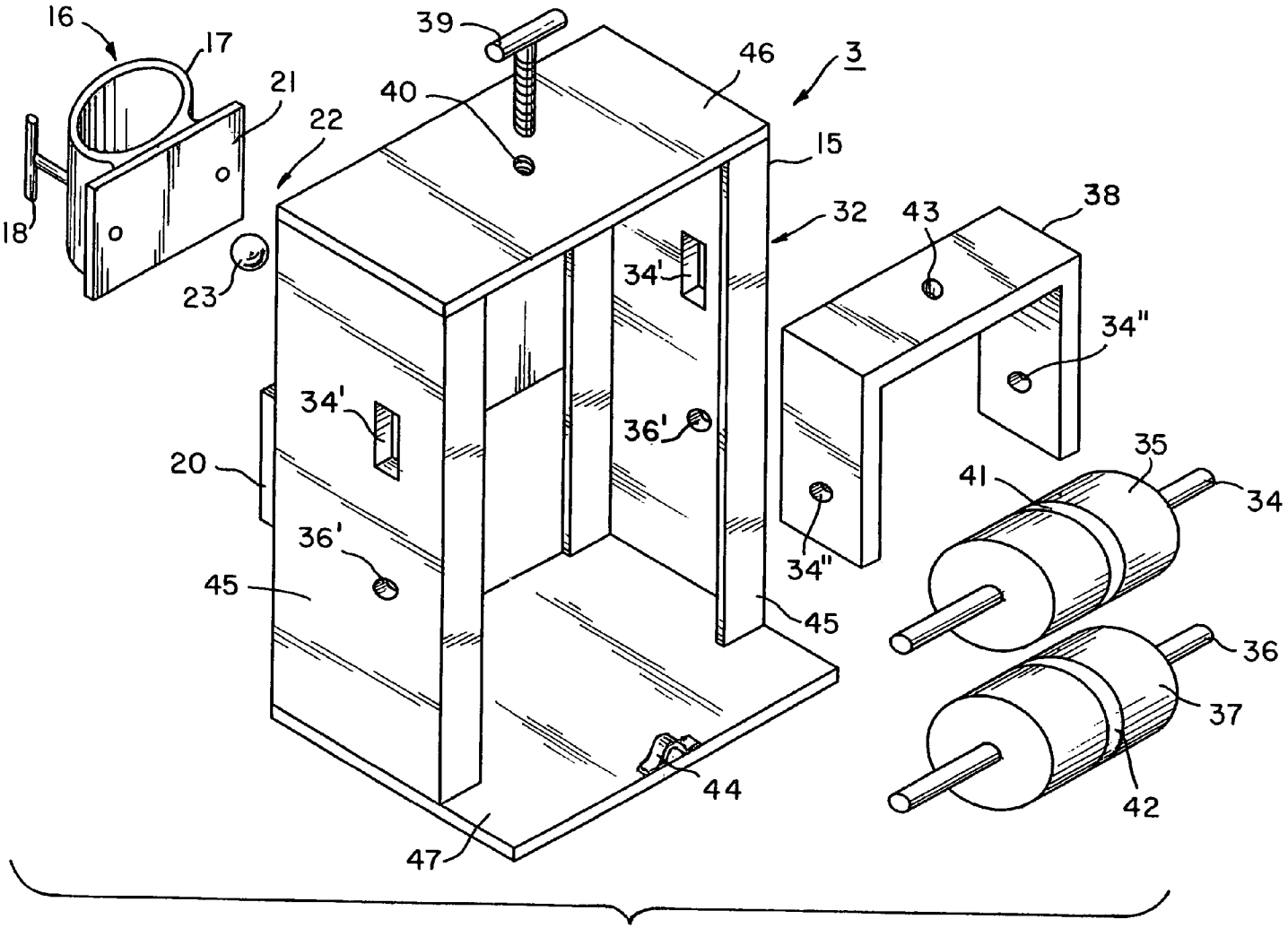
FIG. 4 is an exploded view of selected members of the pivoting and variable resistance head member.

Referring now to FIGS. 4 through 5E, the pivoting and variable resistance head member 3 is described in further detail. As noted above, resistance head 3 optionally includes height and rotation adjusting means 16 and pivot bearing means 22, which may also be understood as an axial bearing means depending upon whether 2 (x-y motion) or 3(x-y-z motion) degrees of freedom are allowed. In this manner, pivot bearing means 22 allows a user to select whether and how much variable resistance head 3 and continuous member 4 pivot or move relative to upright support 2 during use.

Resistance head 3 may also include a compression and work force adjustment means 32 enabling a user to adjust the pulling/climbing resistance placed on continuous member 4 during use, as will be described.

According to the present embodiment, resistance head 3 includes a housing 15 supporting adjustment means 32. Housing 15 includes a top member 46 and a bottom member 47 joined by opposing side members 45, 45. Side members 45, 45 each include opposing and horizontally aligned first guide slots 34', 34' and axle openings 36', 36'. A back wall member 20 spans between side members 45, 45 at any point along their length, as shown.

A first force wheel 35 includes a first axle 34 projecting axially from each side, as shown. At least one guide channel 41 bounds an outer circumference of first force wheel 35, as shown.

A second force wheel 37 includes a second axle 36 projecting axially from each side, as shown. At least one guide channel 42 bounds an outer circumference of second force wheel 37, as shown.

In the present embodiment, and after assembly, guide channels 41, 42 are substantially aligned so that continuous member 4 can be guided by channels 41, 42 during a use and retained in substantially the center of first and second force wheels 35, 37. It should be understood that a vertical, or other alignment, of first and second force wheel 35, 37 is also envisioned as a functional equivalent to the embodiment shown. In sum, the basic elements described in variable resistance head 3 may be repositioned in a non-horizontal manner in an alternative embodiment as the present design would function substantially in the same manner.

A bracket 38, is formed in a generally U-shape effective to join opposing ends of first axle 34 extending through guiding bracket openings 34'', 34'' as shown. It should be understood that, in the present embodiment, opposing extending ends of first axle 34 project through both guiding bracket openings 34'', 34'' and guiding slots 34', 34'. A top portion of bracket 38, after assembly, traverses the top of first force wheel 35 proximate top member 46.

A threaded locking and adjustment member 39 threadably engages a threaded hole 40 in top member 46 proximate the top portion of bracket 38. In the present embodiment a top end portion of adjustment member 39 is formed in a generally T-shape to facilitate easy hand use and tightening by a use while a bottom end portion is threaded to engage threaded hole 40. In the present embodiment a stabilizing pivot retainer 43 is positioned on a top surface of a top portion of bracket 38 to pivotally engage a bottom of adjustment member 39. In use, a pivot retainer receives the bottom of adjustment member 39 and prevents it from shifting relative to bracket 38 or damaging its threads.

Those skilled in the art of exercise equipment design will recognize that in alternative embodiments, pivot retainer 43 may be formed as a simple cup shape or may include pivoting bearing surfaces in alternative embodiments. It should also be recognized that pivot retainer 43 may be optionally excluded from the design altogether, allowing guide slots 34', 34' to guide bracket 38 and first force wheel 35 relative to side members 35.

During use, and as clearly shown in FIGS. 5A and 5B, guide channels 41, 42 are shaped to be shallower than one half the diameter of continuous member 4 forcing first and second force wheels 35, 37 to be spaced apart for the difference. In effect, this difference allows the continuous member 4 to support first force wheel 35, first axle 34, and bracket 38. Since guide slots 34', 34' maintain a first and second axles 34, 36 in parallel, during a use or adjustment, when a compressive force is applied via threaded lock member 39 and threaded hole 40, first force wheel 35 if urged toward second force wheel 37 compressing continuous member 4 within guiding channels 41, 42. The compression of continuous member 4 creates a rolling resistance between first and second force wheels 35, 37, and hence a pulling/climbing resistance to a user pulling on continuous member 4.

One skilled in the art will recognize that alternative embodiments may be envisioned for the construction of pivoting and variable resistance head 3, including the use of narrow pulleys as force wheels 35, 37, and different constructions allowing alternative compressive forces to be placed on continuous member 4.

In the present embodiment, at least one guide bracket 44 is positioned on bottom member 47 in alignment with guide channels 41, 42. While not critical to the operation of exercise apparatus 1 (since guide channels 41, 42 function to self-align continuous member 4), guide bracket 44 is assistive in ensure that the returning portion of continuous member 4 is aligned with guide channels 41, 42 and that any kinks are prevented from entering the resistance head 3.

In the present embodiment, height rotation and adjusting means 16 includes a supportive collar 17 bounding upright support 2. A threaded locking member 18 is threadably joined through collar 17 and enables adjusting means 16 to be positionably locked along the length of upright support 2 to accommodate a variety of users, while enabling resistance head 3 to be removed, repositioned, or pivoted for storage.

A front wall plate 21 projects between supportive collar 17 and back wall 20 of housing 15. Two sloped openings 29, 29 are formed in wall plate 21. Two opposing slotted slide openings 30, 30 extend through back wall 20. Pivot bolts 25A, 25B extend between respective sloped openings 29, 29 and slide openings 30, 30. Pivot bolt heads 31, 31 project through slide openings 30 and rest on the inner surface of back wall 20 as shown. Threaded pivot bolt tails (shown) extend through respective sloped openings 29, 29, as shown. Bearing cups 28, 28 having angled openings 29', 29' surround threaded bolt tales and nuts 26, 26 having respective bearing members 27, 27.

Nuts 26, 26 may be common hex nuts or may be locking nuts depending upon user preference. Bearing members 27, 27 may be separate from or formed integrally with nuts 26, 26 or bearing cups 28, 28. In this manner, one skilled in the art should readily recognize that pivot bolts 25A, 25B are allowed to pivot and slide relative to front wall 21 while sliding relative to back wall 20 along slide openings 30, 30 retained by pivot bolt heads 31, 31.

A pivot socket 24 projects from a back surface of back wall 20 toward front wall 21. A pivot bearing member 23 is seated within pivot socket 24. In the present embodiment, pivot bearing member 23 is spherically formed, but other pivotable shapes are envisioned, each effective to allow and guide back wall 20 (and hence housing 15 and compression means 32) to pivot relative to front wall 21 and vertical support 2. It should be noted, that pivot socket 24 is sufficiently deep to allow pivot bearing member 23 to pivot freely between front and back walls 21, 20 while not allowing bearing member 23 to fall out of pivot socket 24.

In the present embodiment shown, pivoting variable resistance head member 3 is pivotable on three axes (x-y-z) relative to support column 2 resulting from the use of a spherical pivot bearing 23. In an alternative embodiment (not shown) a cylindrical pivot bearing is used allowing resistance head 3 to pivot through two axes (x-y) relative to support column 2.

It should also be recognized, that as desired and adjusted by an end user, bolts 25A, 25B may be tightened, preventing all pivoting motion of resistance head member 3, or may be set at a desired length, acting as pivot stops during a use.

Figure 6B:
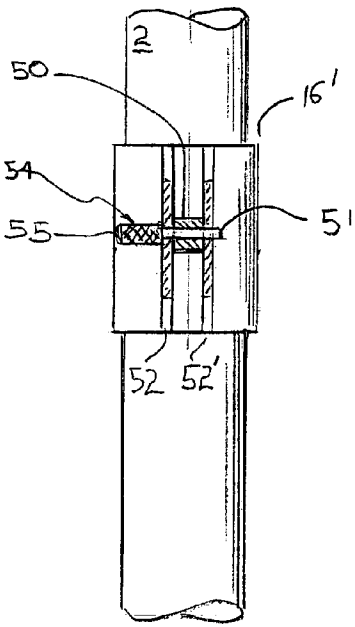
FIG. 6B is a sectional view along line 6B-6B in FIG. 6A.
Figure 6A:
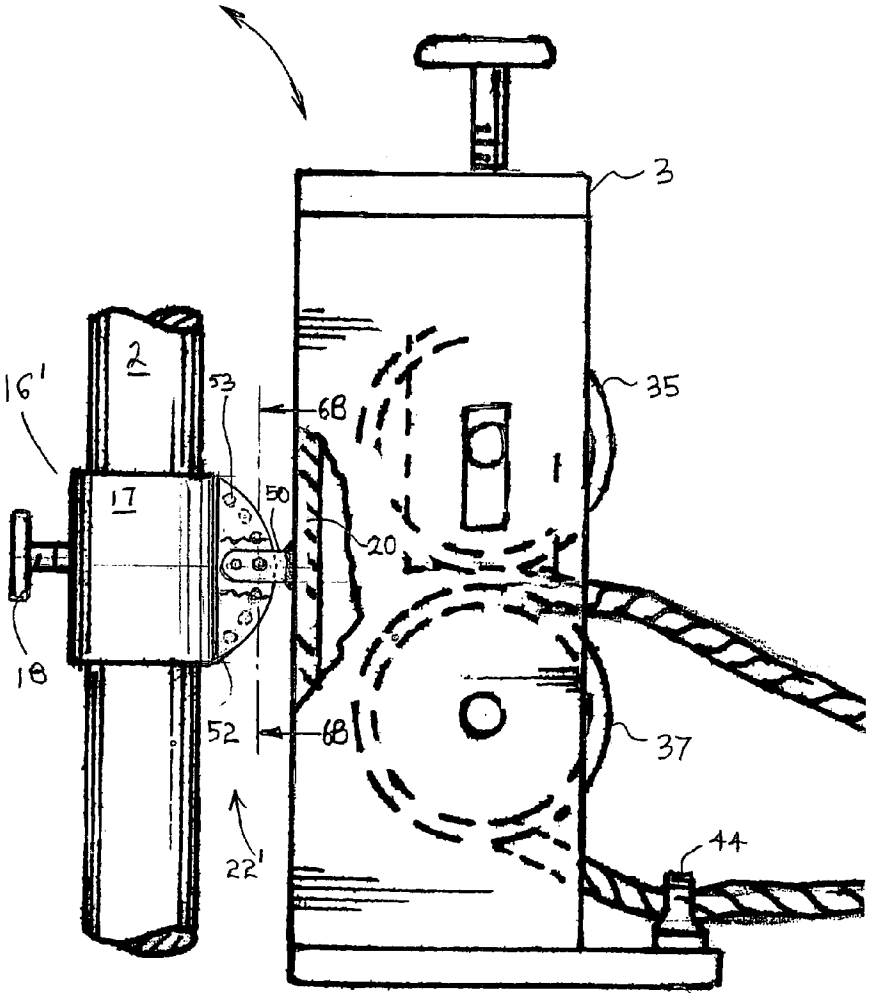
FIG. 6A is a partial cut away side view of one embodiment of the present invention.

Referring now to FIGS. 6A and 6B, where an alternate embodiment of the present invention includes an alternate height and rotation adjusting means 16' and an alternate pivot bearing means 22' similar to the previously described means 16 and 22.

In this alternative embodiment a pivot arm 50 fixably extends from back wall 20 of the pivoting variable resistance head 3. A distal end of pivot arm 50 is pivotally joined to a surface of collar 17 as shown at pivot axis 51. Collar 17 is adjustably positionable and removable along upright support 2 via threaded locking member 18. In this embodiment, two flanges 52, and 52' project outwardly from the outer surface of collar 17. Pivot axis 51 is between flanges 52, 52'. A plurality of holes 53 are arrayed about an outer surface of flanges 52, 52'. In the present embodiment the outer surface of flanges 52, 52' are curved, but alternative embodiments are envisioned as long as they are effective to provide a locking pivot joint as will be described.

A plurality of holes, or at least one hole is positioned through pivot arm 50 and is coaxially alignable with the at least one or a plurality of holes 53 on flanges 52, 52'. A locking pin 54 having a knob 55 is positionable through coaxially aligned pivot arm hole and holes 53 in flanges 52. 52'.

During use, pin 54 extends through flanges 52, 52', and pivot arm 50 securing a relative position of resistance head 3 relative to upright support 2, a user, and where present a user support 5.

One skilled in the art will readily understand having viewed the alternative pivoting and adjustment means described hereinabove, that alternative modifications are available to secure the same results, namely a user adjustable and repositionable resistance head providing security of use and convenience and selection of a pulling angle between the continuous member and a user. As such the physical embodiments described herein are only illustrative of the present invention and are not limitations thereto.

In response to the design of the present embodiment, it should be understood that in use, as a user on user support 5 first sits-up and pulls with a first hand on continuous member 4, resistance head 3 (having been positionably adjusted to a preferred user setting) optionally pivots to allow continuous member 4 to be pulled away from first and second force wheels 35, 37. At the end of this motion, the user is tilted back down away from upright support 2. The user then conducts a second sit-up motion and grasps and pulls continuous member 4 with the other hand, and resistance head 3 pivots towards the other side of the user's body ensuring that the pulling motion remains perpendicular away from the resistance head.

Where selected by a user, as resistance head 3 pivots (side to side—2 dimensions or alternatively side-to-side and up-down—3 dimensions), bolts 25A, 25B slide and pivot in respective slide openings 30 and sloped openings 29, while bearing members 27 pivot in bearing cups 28.

In use it should be understood, that a user, for example of less than average height, may first operate height adjustment means 9 to position user support 5 at a proper height. It is also clear that height adjustment means 9 and 16 may be considered together as a means for positioning and repositioning the continuous member relative to at least one of the upright support, a user, and where included the user support, since moving either adjustment means 9, 16 may change the relevant positions. Where a user has particularly long arms, the user may wish to adjust height rotation and adjusting means 16, 16' to raise resistance head 3 far above user support 5 and so allow a full-length pulling action.

The user may then loosen and height rotation adjusting means 16 and slide resistance head 3 downward to compensate for the user's shorter arms, trunk and legs. The user may additionally adjust compression and work force adjustment means 32 to selectively choose a desired work force/pulling amount. Finally the user may also determine how much pivot/swivel (x-y or x-y-z) is desired by varying the tension placed on pivot bolts 25A, 25B. In this manner it is readily envisioned that the present invention is easily adapted to a broad range of body types, fitness levels, and desired operation styles.

It is envisioned that based on the present embodiment disclosed multiple alternative embodiments and adaptations may be developed.

One such alternative embodiment (not shown) involves the integration of elastic resistive members with upright support 2 and user support 5 in exercise apparatus 1. In this envisioned alternative embodiment, the elastic resistive members are arranged in a Bowflex®-type arrangement wherein a series variable resistance elastic members are fixed proximate upright support 2 and joined to pulling elements either directly or through a cable/pulley arrangement allowing a user to sit upright or reversed on user support 5 to operate the pulling elements and experience an elastic resistive exercise.

In yet another alternative embodiment, upright support 2 is adapted to support weights and/or bars for lifting the weights by a user relative to user support 5. In this envisioned embodiment, central support column is utilized as a supporting structure and consequently includes fixed or removable support members (both not shown) for supporting the weights and/or bars for lifting the weights. In this embodiment, a user sitting or lying on the user support 5, or standing relative to upright support 2, lifts the weights from the support members and exercises with the weights in a conventional manner.

In another alternative embodiment, upright support 2, and or user support 5 and resistance head 3, are adapted for the additional use with an elastic or other weight resistance means (not shown) utilizing the central support column as a support structure relative to a user. In this envisioned embodiment, elastic resistance members (i.e. elastic type straps) are secured to the support column, either alone or in pairs, and a user positioned distant from the support column pulls the resistance members away from the anchoring support 2 achieving a strengthening exercise. In an adaptation of this alternative embodiment, the elastic members are operated through a series of pulleys, allowing more convenient orientation options for a user.

In yet another alternative embodiment, exercise apparatus 1 is additionally combined with an electronic measurement device and attachments for counting at least one of the time of use, the number of pulls, the combined length of continuous member 4 climbed or pulled, etc. It is also envisioned that the electronic measurement device (not shown) include a display and a calculating modules capable of determining equivalence of energy used or work done during exercise, along with various programed ramped rates for user guidance and visual user feedback. In this manner, it is envisioned that the present embodiment described may be programed by a user prior or during use, and during use the electronic device provides a continuous calculation of work done/number of pulls etc. or other useful information for the user.

In another alternative embodiment of the present invention, guide bracket 44 is removed, and gripping projections (not shown) are affixed alternatingly along the length of continuous member 4. The gripping projections are sized to fit through the gap between first and second force wheels 35, 37 or force wheels 35, 37 are sized to resemble narrow pulleys allowing the gripping projections to pass beyond the pulleys within generally U-shaped bracket 38. In this embodiment, a user grasps the gripping projections with an overhand or under hand grip (i.e. the gripping projections operate as oar-tip like ends).

In another alternative embodiment, user support 5 is either removed and a user operates exercise apparatus 1 without the support, or user support 5 is replaced with a shorter version, both circumstances allowing a user to face pivoting and variable resistance head 3 from a standing or kneeling position. In this manner, the above-described sit-up action is eliminated, but the position enables a user's shoulders to be positioned above a lowered height rotation adjusting means 16. Consequently, the user may operate the present exercise apparatus 1 in an upward-pulling action (i.e. pulling a rope upward from an underhand grip), or a downward-pulling action (pulling their chest forward) each position placing greater work emphasis on the biceps and upper body It should be clear from the above discussion that the present invention, and each of the embodiments discussed overcomes the detriments previously noted in the conventional art. The present invention is readily adapted to enable users of all types (from handicapped or poor condition to athletes) to engage their limbs for exercise in a safe and controllable manner. It is also clear that exercise regimens may be readily adapted for exercise apparatus 1 covering both anaerobic and aerobic results. It should also be clear, that with the user positioning depicted (in any connotation) it is possible In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be and should be understood by those skilled in the art that the invention is not limited to those precise embodiments, and that various changes, modifications, and adaptations may be effected therein by one skilled in the art without departing from the scope or spirit of the invention as defined in the appended claims. Accordingly, all such modifications are intended to be included within the spirit and scope of this invention as defined in the following claims.

What is claimed is:

1. A portable exercise device, comprising:

at least one upright support member;

at least one user support projecting away from said support member;

a continuous member;

means for positioning and lockably repositioning at least one of said continuous member and said user support relative to said at least said other and said upright support;

means for adjusting a pulling resistance of said continuous member, whereby said means for adjusting enables a user to select at least one desired pulling resistance of said continuous member during a use; and at least one means for pivoting said means for adjusting relative to at least one of said upright support, said user support and said user during said use.

2. A portable exercise device, according to claim 1, wherein:

said means for pivoting includes at least one of a means for pivoting along a plane extending generally parallel to said upright support member and a means for pivoting along both said generally parallel plane and a direction generally perpendicular with said upright support, whereby during said use said user may optionally adjust at least one of an pulling angle of said continuous member in a pulling direction and a side-to-side pivot angle of said continuous member relative to said user, said means for adjusting being alignable and realignable in a user desired position including a direction perpendicular to said pulling direction.

3. A portable exercise device, according to claim 2, wherein:

said means for positioning includes a first means for slidably positioning one end of said user support on said upright support member; whereby a slope of said user support is easily adjusted relative to said upright support member and said user support may separated from or be positioned proximate to said upright support member during a storage of said device for user convenience.

4. A portable exercise device, according to claim 2, wherein:

said means for positioning includes at least first means for slidably positioning said user support into at least one of a use position during said use and in a transport position during a non-use of said exercise device, whereby said use and a portability of said exercise device is improved.

5. A portable exercise device, according to claim 4, wherein:

said means for positioning includes at least second means for slidably positioning said means for adjusting on said upright support member during said use and a transport of said device, whereby said use and said portability of said exercise device is improved.

6. A portable exercise device, according to claim 5, further comprising:

at least a second locking member and a second collar member in said second means for slidably positioning;

said second collar member on said upright support member;

said second locking member engaging said collar member in at least one of a threadable engagement and a slidable engagement;

said second collar member positioning said first locking member relative to said upright support member during said use and transport; and said second locking member engageable with said upright support member at a plurality of positions enabling a convenient collapsible use and transport of said portable exercise device.

7. A portable exercise device, according to claim 4, further comprising:

at least a first locking member and a collar member in said first means for slidably positioning;

said collar member on said upright support member;

said first locking member engaging said collar member in at least one of a threadable engagement and a sliding engagement;

said collar member positioning said first locking member relative to said upright support member during said use and said transport; and said first locking member engageable with said upright support member at a plurality of positions enabling a convenient use and transport of said portable exercise device.

8. A portable exercise device, according to claim 2, wherein:

said means for pivoting said means for adjusting further comprises:

a first bearing surface in said means for positioning and repositioning;

a second bearing surface in said means for adjusting; and pivot bearing means between said first and second bearing surfaces for enabling respective motion of said first and second bearing surfaces during said use.

9. A portable exercise device, according to claim 8, wherein:

said means for pivoting said means for adjusting further comprises:

at least one means for limiting a pivot range of said means for pivoting relative to said upright support member during said use;

at least one pivot limiting member in said means for limiting;

said pivot limiting member pivotably extending between said first and second bearing surfaces;

a first end of said pivot limiting member extending through a slide opening in said second bearing surface;

a second end of said pivot limiting member opposite said first end;

said second end extending through a sloped opening in said first bearing surface;

means for threadably adjusting a distance between said first and second ends of said pivot limiting member in said means for limiting, whereby said means for threadably adjusting enables an adjustment of a distance between said first and second bearing surfaces; and said slide opening and said sloped opening enabling said pivot limiting member to shift relative to both said first and second bearing surfaces during said use, thereby limiting a pivot movement of said means for adjusting when a pivot amount is equivalent to said distance.

10. A portable exercise device, according to claim 1, further comprising:

at least one pivot joint pivotally joining a proximate end of said user support with said upright support member, whereby said user support is adjustable to accommodate a variety of user abilities, body shapes, and slope preferences.

11. A portable exercise device, according to claim 10, wherein:

said at least one pivot joint enabling said user support to be at least one of pivotally repositioned into close proximity with said upright support member and separable from said upright support, whereby a convenient portability of said exercise device is increased.

12. A portable exercise device, according to claim 11, further comprising:

at least one user limb restraint on a user side of said user support; and said user limb restraint being at least one of a generally T-shaped restraint and a generally U-shaped restraint, whereby during said use, said user limb restraint enables said user to restrain their motion relative to said continuous member and said upright support member.

13. A portable exercise device, according to claim 10, further comprising:

at least one bracing member; and said at least one bracing member forming at least one of a fixed, an adjustable, and a releaseable connection between said user support and said upright support member during said use, whereby said bracing member stabilizes said user support during said use and enables easy reconfiguration of said exercise device into a portable condition.

14. A portable exercise device, according to claim 10, further comprising:

at least one supportive leg element on said user support opposite said upright support member; and said at least one leg element supporting said user support relative to an external support surface, whereby said at least one leg element provides an additional stability to said user support during said use.

15. A portable exercise device, according to claim 1, further comprising:

a support member on a bottom side of said upright support member, and said support member including at least one leg extending away from said upright support, whereby said support member and said at least one leg stabilizing said upright support member relative to an external work surface during said use while allowing a simple compaction and portability of said exercise device.

16. A portable exercise device, according to claim 15, further comprising:

at least one of a rolling member and a sliding surface on support member, whereby said at least one enables a rapid portability and transport of said exercise device by said user after said use.

17. A portable exercise device, according to claim 1, wherein:

said means for adjusting said pulling resistance further comprises:

a housing;

a first rolling means and a second rolling means;

said first rolling means in said housing pivotable along a first pivot axis;

said second rolling means in said housing pivotable along a second pivot axis;

said first and second pivot axes parallel to each other;

said continuous member passing between and contacting said first and second rolling means; and means for urging said second rolling means toward said first rolling means, whereby said means for urging provides a compression force on said continuous member passing between said first and second rolling means during said use thereby enabling a selection of said pulling resistance during said use.

18. A portable exercise device, according to claim 17, further comprising:

a bracket in said housing;

said bracket movable from a first position to at least a second position;

said bracket controllably guiding said second rolling means in said housing relative to said first rolling means;

a threaded member in said means for urging; and said threaded member threadably engaging said housing and adjustably urging said bracket and said second rolling means toward said first rolling means, whereby said threaded member enables a threaded selection of said pulling resistance during said use.

19. A portable exercise device, according to claim 18, further comprising:

at least one guide member on said housing; and said at least one guide member positioned at an upstream position from said first and second rolling means, whereby said at least one guide bracket provides an initial alignment to said continuous member during said use prior to said continuous member entering said first and second guide channels.

20. A portable exercise device, according to claim 17, further comprising:

a first guide channel on said first rolling means;

a second guide channel on said second rolling means;

said first and second guide channels radially aligned with each other; and said first and second guide channels providing a guiding alignment to said continuous member during said use, whereby said means for adjusting enables a continuous alignment and realignment of said continuous member during said use.

21. A portable exercise device, according to claim 1, wherein:

said means for pivoting said means for adjusting further comprises:

a pivot arm pivotally joining said means for positioning and said means for adjusting;

at least one flange projecting from said means for positioning proximate said pivot arm;

said flange including a plurality of flange holes arrayed about an outer surface;

said pivot arm including at least one pin hole alignable with at least one of said plurality of flange holes during a use of said means for pivoting; and at least one engagement pin extending through both said at least one pin hole and a user-selected one of said plurality of flange holes, enabling a selective engagement and disengagement of said flange and said pivot arm, whereby said means for pivoting allows a user to determine an angle of said means for adjusting relative to said upright support and a pulling angle of said continuous member.

22. A portable exercise device, comprising:

at least one upright support member;

a continuous member;

means for positioning and repositioning said continuous member relative to at least said support member during a use;

means for adjusting a pulling resistance of said continuous member, whereby said means for adjusting enables a user to select at least one desired pulling resistance of said continuous member during a use while said means for positioning enables a user to position said continuous member at least a selected convenient position;

at least one user support projecting away from said support member; and at least one means for pivoting said means for adjusting relative to at least one of said user support and said user during said use.

23. A portable exercise device, according to claim 22, wherein:

said means for pivoting includes means for pivoting along at least one of a plane extending generally perpendicular to said upright support member and a direction generally aligned with said upright support, whereby during said use as said user pulls on said continuous member in a pulling direction, said means for adjusting aligns and realigns into a position perpendicular to said pulling direction.

24. A portable exercise device, according to claim 23, wherein:

said means for adjusting a pulling resistance further includes means for applying a compressive force upon a portion of said continuous member, whereby said compressive force applied to said portion increases said user's pulling resistance.

25. A portable exercise device, comprising:

at least one upright support member;

a continuous member;

means for positioning and repositioning said continuous member relative to at least said support member;

means for adjusting a pulling resistance of said continuous member, whereby said means for adjusting enables a user to select at least one desired pulling resistance of said continuous member during a use while said means for positioning enables a user to position said continuous member at least a first selected convenient position; and at least one means for pivoting and aligning said means for adjusting relative to at least a position perpendicular to a user-pulling direction during a use.

26. A portable exercise device, according to claim 25, further comprising:

portability means for repositioning at least one of said continuous member, said means for positioning, said means for adjusting, and said means for pivoting after said use, whereby said portability means enables said use to reposition said exercise device into a compact shape enabling safe and convenient transport.

27. A portable exercise device, comprising:

at least one upright support member;

a continuous member;

means for positioning and lockably repositioning said continuous member relative to at least said support member;

means for adjusting a pulling resistance of said continuous member, whereby said means for adjusting enables a user to select at least one desired pulling resistance of said continuous member during a use while said means for positioning and lockably repositioning enables a user to position said continuous member at least a first of a plurality of selected convenient position; and electronic means for recording, determining, and displaying an amount of exercise conducted by said user during said use of said exercise device.

28. A portable exercise device, according to claim 27, further comprising:

at least one of a means for providing a weight lifting exercise to said user during said use and a means for providing an elastomeric exercise to said user during said use, and said upright support column supporting said one of said weight lifting exercise and said elastomeric exercise, whereby said exercise device includes an exercise mechanism of said continuous member and said additional at least one means for exercising.

29. A portable exercise device, comprising:

at least one upright support member;

a continuous member;

means for positioning and lockably repositioning said continuous member relative to at least said support member at a plurality of angles during a use; and means for adjusting a pulling resistance of said continuous member, whereby said means for adjusting enables a user to select at least one desired pulling resistance of said continuous member during a use while said means for positioning enables a user to position said continuous member at at least a selected convenient position.

* * * * *